US005745920A

United States Patent [19]

Olivier

[11] Patent Number: 5,745,920

[45] Date of Patent: May 5, 1998

[54] HAND STRAP FOR USE WITH A WEIGHTLIFTING BAR

[76] Inventor: W. Christopher Olivier, P.O. Box 56431, Houston, Tex. 77256

[21] Appl. No.: 831,249

[22] Filed: Apr. 7, 1997

[51] Int. Cl.[6] ..... A41D 19/00

[52] U.S. Cl. ..... 2/170; 2/161.1

[58] Field of Search ..... 63/3, 11, 5.2; 446/486, 446/26; 2/170, 161.1; 482/92

[56] References Cited

U.S. PATENT DOCUMENTS

| | | | |
|---|---|---|---|
| 3,410,023 | 11/1968 | Anello | 446/486 X |
| 4,724,548 | 2/1988 | London | 63/11 X |
| 5,004,231 | 4/1991 | Alread | 2/161.1 X |
| 5,298,001 | 3/1994 | Goodson | 2/170 X |
| 5,557,806 | 9/1996 | Caswell et al. | 2/161.1 |

*Primary Examiner*—C. D. Crowder
*Assistant Examiner*—Shirra L. Jenkins

[57] ABSTRACT

A weightlifting hand strap for use with a weightlifting bar having a spring strip, a strap of fibrous material covering an exterior of the spring strip, and a wrist loop formed at an end of the strap. The wrist loop serves to extend around a human wrist. The spring strip is a self-coiling strip which is operable to self-roll to thereby roll up the strip around the weightlifting bar. The strap covers the strip such that the strip resides interior of the strap. The wrist loop is formed of a fibrous material integrally connected with the strap. The wrist loop extends outwardly generally transversely to the longitudinal axis of the strap. The spring strip is operable so as to self-roll in a direction facing the wrist loop.

20 Claims, 1 Drawing Sheet

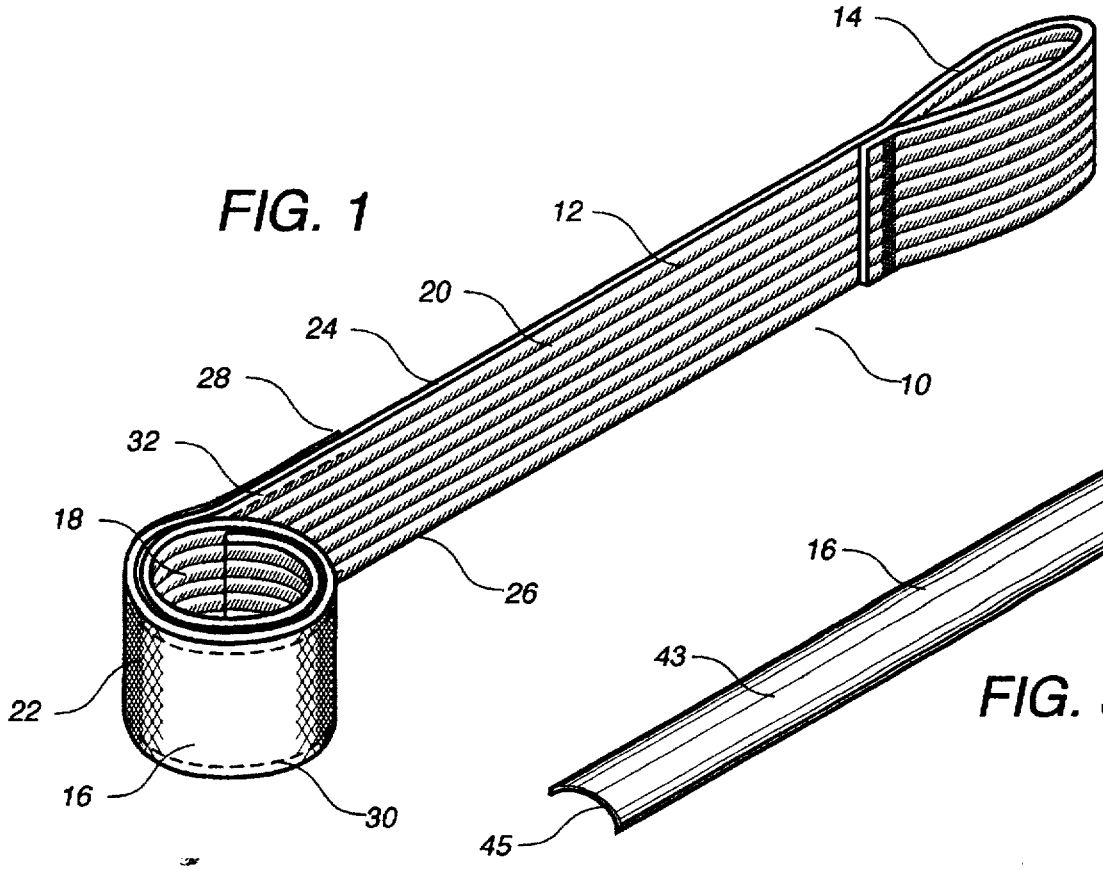
FIG. 1
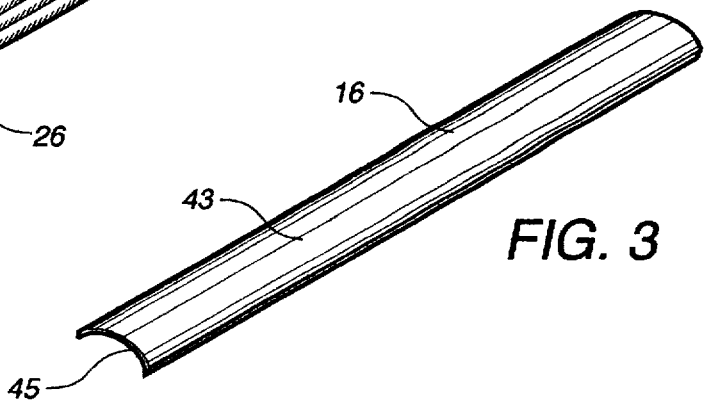
FIG. 3
FIG. 2
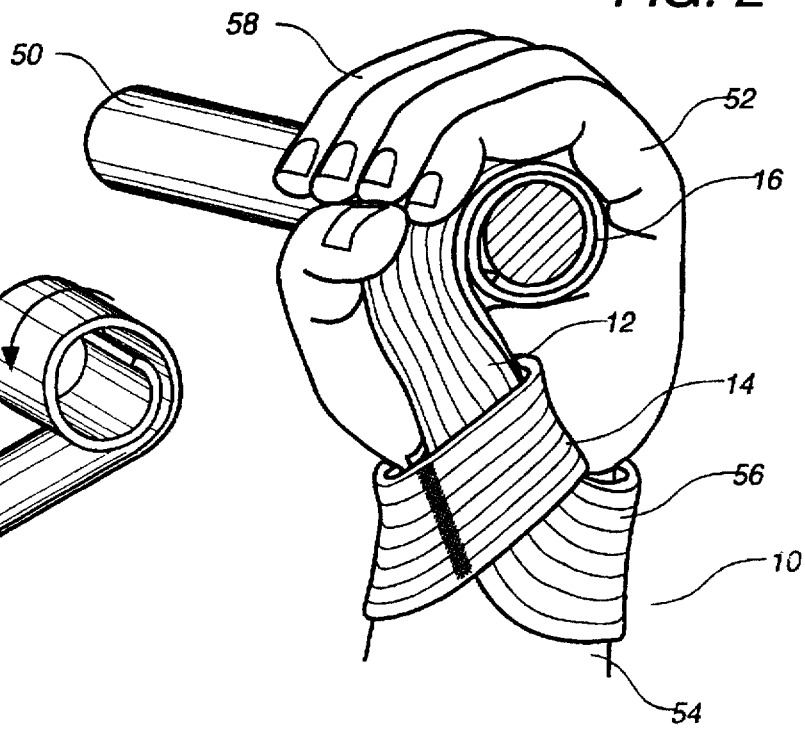
FIG. 4
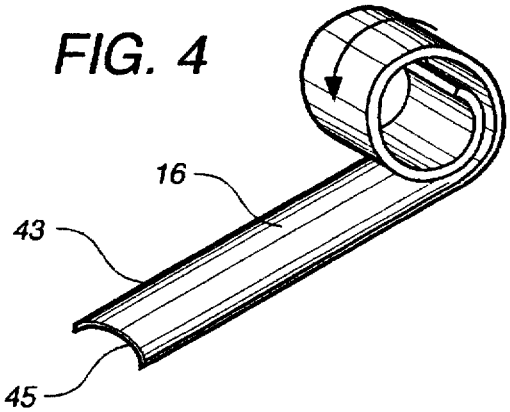

HAND STRAP FOR USE WITH A WEIGHTLIFTING BAR

TECHNICAL FIELD

The present invention relates to devices for facilitating weightlifting activities. More particularly, the present invention relates to gloves and other devices which allow the weightlifter to more securely grip the weightlifting bar.

BACKGROUND ART

Weightlifting is a common form of exercise for many people. During the lifting of weights, such as barbells, the hands of the person are applied around a bar which extends between weighted objects at the opposite ends of the bar. In normal use, the bar can be raised and lowered with one or with two hands. It is often common for weightlifters to use talc, or other resinous material, on their hands prior to lifting the barbells. The purpose of applying such material to the weightlifter's hands is to facilitate the ability to get a good grip on the weightlifting bar. If the weightlifter does not get a "good grip" on the bar, then a less desired amount of weight can be lifted or, in certain circumstances, the weightlifter can lose his or her grip on the bar. The loss of the grip on the bar can possibly result in serious injury to the weightlifter or to persons in the vicinity of the weightlifter. As such, a need has developed in which to facilitate the ability of the weightlifter to get such a "good grip" on the weightlifting bar.

In the past, various devices have been developed so as to facilitate the ability of the weightlifter to grip" on the weightlifting bar. One device which has been used in the past is a strap which includes a wrist loop material extending outwardly from the wrist Conventionally, the weightlfter will loop the strap around the exterior of the weightlifting bar and then grip the "looped" material with his or her hands. Fortunately, the "looped" material does not give a very good grip on the bar and can easily come loose. Many times, this type of gripping apparatus actually does more harm than good.

In the past, some patents have issued relating to weightlifting gloves. For example, U.S. Pat. No. 5,557,806, issued on Sep. 24, 1996, to Caswell et al. teaches a weightlifting glove having a support strap which is attachable to the bar of the weight to be lifted. The glove includes a glove member and a strap. The strap has a free end, an attached end, and a running portion. When the hand is inserted into the glove member, the running portion of the strap is brought from the wrist, through the sleeve, to angularly cross the palm side of the glove member. The strap is then wrapped around the weightlifting bar. Fastener strips are provided on the strap so as to releasably and adjustably secure the strap around the bar.

U.S. Pat. No. 5,004,231, issued on Apr. 2, 1991, to D. Alread teaches a weightlifting glove which includes a wrist strap which is securable to enclose the individual's wrist. A loop member and a free strap is secured to opposite ends of the wriststrap member to provide an encompassing strap for securing to the weightlifting bar.

In actual use, these weightlifting gloves are not effective devices for the weightlifting activity. The straps that are used on these weightlifting gloves extend outwardly in the direction of the fingers. As such, the weightlifter must use additional gripping forces so as to securely maintain the strap in its proper position. Furthermore, the forces that are imparted from the weightlifting bar are transferred to the material of the glove. As a result, a tearing of the glove can occur. In general, since the strap loops around the bar in the direction of the fingers, it gives no added support during the weightlifting activities.

Various types of gripping gloves have been developed in other fields of endeavor. For example, U.S. Pat. No. 5,353,440, issued on Oct. 11, 1994, to W. B. Meldeau teaches a grip glove that can be used in conjunction with a ski rope. This glove includes a protuberance on a grip strap so as to provide a bearing surface against the bar. U.S. Pat. No. 5,298,001, issued on Mar. 29, 1994, to M. P. Goodson teaches a strap of leather which extends along the palm of the user's hand. This gripping apparatus is intended for use with gymnastics activities. The finger end of the strap has a dowel extending sideways. Beyond the dowel are a couple of holes through which the two middle fingers extend during use. The distal end of the strap folds back over the dowel and the fingers extend through the holes. U.S. Pat. No. 4,720,279, issued on Jan. 19, 1988, to Fritschen et al. teaches a gripping device for use with water sports equipment. The device includes a grip strap of a webbing material, a protuberant rib which extends transversely of the strap, and at least one finger-attaching member near the rib at one end of the grip strap. The grip is constructed such that when, in use, a wearer's fingers are extended, the palm strap becomes taut between the finger attachment member and the wrist strap such that the wearer's retained fingers are supported in a hooked position.

It is an object of the present invention to provide a hand strap which facilitates the ability to carry out weightlifting activities.

It is a further object of the present invention to provide a hand strap which facilitates the ability to grip the weightlifting bar.

It is a further object of the present invention to provide a hand strap which can be easily and adaptably applied to various weightlifting bars.

It is a further object of the present invention to provide a hand strap which transfers a great deal of the weightlifting force to the wrist of the weightlifter.

It is a further object of the present invention to provide a hand strap for weightlifting which is easy to use, easy to manufacture, and relatively inexpensive.

These and other objects and advantages of the present invention will become apparent from a reading of the attached specification and appended claims.

SUMMARY OF THE INVENTION

The present invention is a weightlifting hand strap for use with a weightlifting bar that comprises a spring strip, a strap of fibrous material covering an exterior of the spring strip, and a wrist receiving loop formed at an end of the strap. The wrist receiving loop extends around a human wrist. The strap extends outwardly from this wrist receiving loop.

In the present invention, the spring strip is a self-coiling strip which is operable so as to self-roll to thereby roll up the strip around the weightlifting bar. This self-coiling strip has a concave side and a convex side and a property that, when straightened, the strip holds its straightened shape and, when bent in a predetermined direction, the strip self-rolls around the weightlifting bar. The strap completely covers the strip so that the strip resides interior of the strap.

The strap has an an inner material surface and an outer material surface. The strip is received between the inner and outer material surfaces. The inner material surface and the outer material surface have edges which are affixed together so as to contain the strip between the edges and between the inner and outer material surfaces. The inner material surface and the outer material surface are each formed of a cloth material.

The wrist receiving loop is formed of fibrous material integrally connected to the strap. In particular, the wrist loop includes a receiving loop formed at an end of the strap. The receiving loop has an inner diameter suitable for allowing the strap to pass therethrough. The strap extends through the receiving loop so as to form the wrist loop. The spring strip is affixed to the strap at a distal end of the strap from the wrist loop. The wrist loop extends outwardly generally transversely of a longitudinal axis of the strap. The spring strip serves to self-roll in a direction toward the wrist loop. As such, when the loop extends around the weightlifting bar, it extends in the direction opposite the fingers so as to provide a better gripping surface for the weightlifter.

BRIEF DESCRIPTION OF THE DRAWINGS

FIG. 1 is a perspective view of the hand strap in accordance with the preferred embodiment of the present invention.

FIG. 2 is an illustration of the use of the hand strap of the present invention in conjunction with a weightlifting bar.

FIG. 3 is a perspective view of the spring strip in its straightened condition as used in the present invention.

FIG. 4 is a perspective view of the spring strip as used in the present invention in its self-coiling arrangement.

DETAILED DESCRIPTION OF THE INVENTION

Referring to FIG. 1, there is shown at 10 the hand strap for use with a weightlifting bar in accordance with the preferred embodiment of the present invention. The hand strap 10 includes a strap 12 having a receiving loop 14 formed at one end. A spring strip 16 is affixed within the interior of the strap 12 so as to coil the strap 12 in a direction toward the receiving loop 14. The receiving loop 14 and an end of the strap 12 serves to form a wrist receiving means for the hand strap of the present invention. It can be seen that the spring strip 16 is coiled so as to form an interior area 18 in the strap 12 for the receipt of a weightlifting bar therein.

The strap 12 is formed of a fibrous material, such as cloth or canvas. The strap 12 covers the exterior of the spring strip 16 such that, when in its coiled condition (as shown in FIG. 1), the strap 12 is in surface-to-surface contact with itself. The strap includes an inner material surface 20 and an outer material surface 22. The strip 16 is received between the inner material surface 20 and the outer material surface 22. The inner material surface 20 and the outer material surface 22 have edges 24 and 26 which are affixed together so as to contain the spring strip 16 between the edges 24 and 26 and between the surfaces 20 and 22. Both the inner material surface 20 and the outer material surface 22 are formed of a fibrous material, such as cloth or canvas. In FIG. 1, it can be seen that the outer material surface 22 has an end 28 which is affixed to the inner material surface 20 a distance away from the receiving loop 14. The area between the receiving loop 14 and the end 28 of the outer material surface 22 forms the area for the forming of the wrist loop as used in the weightlifting activity. In conventional practice, the edges 24 and 26 of the inner material surface 20 and the outer material surface 22 are stitched together by stitchings 30 and 32.

FIGS. 3 and 4 show the spring strip 16 as received within the strap 12 of the hand strap. The spring strip 16 includes a concave surface 43 and a convex surface 45. When straightened, as shown in FIG. 3, the concave/convex surfaces tend to keep the self-rolling strip 16 straight. However, once a bending of the strip 16 occurs, as shown in FIG. 4, it self-rolls itself. As can be seen in FIG. 4, the arrow illustrates the rolling direction of one end of the self-rolling spring strip 16 toward the other end. Typically, the spring strip 16 can be formed of a plastic covered metallic material. The self-rolling of the spring strip 16, as illustrated in FIGS. 3 and 4, allows the strap 12 to be securely received around the exterior of a weightlifting bar. This arrangement is illustrated, with greater particularity, in FIG. 2.

In FIG. 2, it can be seen that a weightlifting bar 50 is received within a human hand 52. The hand strap 10 will extend around the wrist 54 of the hand 52. So as to form the wrist loop 56, a portion of the strap 12 will extend through the interior of the receiving loop 14. The interior of the receiving loop 14 has a diameter suitable for allowing the strap 12 to extend therethrough. The strap 12 will extend upwardly from the wrist 54 toward the palm of the hand 52. Importantly, it can be seen that the self-coiling spring strip 16 causes the strap 12 to coil upon itself in a direction opposite to the direction of the fingers 58 of hand 52. Stated otherwise, it is illustrated in FIG. 2 that the wrist-receiving loop 56 extends generally transversely outwardly from the longitudinal axis of the strap 12. The self-coiling strip 16 will cause the strap 12 to coil in a direction facing (i.e. toward) the wrist-receiving loop 56. The self-coiling strip 16 will automatically cause the strap 12 to wrap around the exterior of the weightlifting bar 50 in a tight and secure configuration. As such, only a minimal force is required so as to maintain the strap 12 in its secured position around the exterior of the weightlifting bar 50. Importantly, and unexpectedly, it was found that the looping of the spring strip 16 in the direction toward the wrist loop 56 facilitates this gripping action. This is in contrast to prior art weightlifting straps which loop around the weightlifting bar 50 in a direction toward the fingers 58.

As can be seen in FIG. 2, the hand 52 is placed over the coiled portion of the strap 12 simply to hold the coil in place. The coil 16 serves to hold the bar 50 in place. Since the strap 12 is integrally connected to the wrist-receiving loop 56, there are no forces that would cause the strap 12 to become separated from other items, such as a glove. As such, any forces that would cause the strap 12 to become separated from the bar 50 would be imparted to the wrist 54 of the weightlifter. The cloth-against-cloth configuration of the coiled portion of the strap 12 gives better resistance against release then would otherwise be expected. This greater friction assures that a strong gripping force is imparted by the coiled portion of the strap 12.

Unlike the prior art straps, the coiled portion of the strap 12 can be easily placed around the exterior of the bar 50. There is no need to affix VELCRO™ strips against one another. There are no complicated assembly mechanisms that must be undertaken prior to lifting the weights. The strap 12 can be installed around the weightlifting bar simply by straightening the spring strip 16 in the manner shown in FIG. 3. The spring strip 16 can be then be bent so that it automatically coils around an interior surface. After the weightlifting activity has been completed, the hand 52 can be removed from the weightlifting bar and the spring strip 16 easily uncoiled. As such, the weightlifter can go between various weightlifting bars in a quick and expeditious manner.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A weightlifting hand strap for use with a weightlifting bar comprising:

a spring strip;

a strap of fibrous material covering an exterior of said spring strip; and a wrist receiving means formed at an end of said strap, said wrist receiving means for extending around a human wrist, said strap extending outwardly from said wrist receiving means.

2. The hand strap of claim 1, said spring strip being a self-coiling strip operable so as to self-roll to thereby roll up said strip around the weightlifting bar.

3. The hand strap of claim 2, said self-coiling strip having a concave side and a convex side and a property that when straightened the strip holds its straightened shape and when bent in a predetermined direction said strip self-rolls around the weightlifting bar.

4. The hand strap of claim 1, said strap covering said strip such that said strip resides interior of said strap.

5. The hand strap of claim 4, said strap comprising:

an inner material surface; and an outer material surface, said strip received between said inner material surface and said outer material surface, said inner material surface and said outer material surface having edges affixed together so as to contain said strip between said edges and between said inner material surface and said outer material surface.

6. The hand strap of claim 5, said inner material surface and said outer material surface each being formed of a cloth material.

7. The hand strap of claim 1, said wrist receiving means comprising a wrist loop formed of said fibrous material integrally connected to said strap.

8. The hand strap of claim 7, said wrist loop comprising:

a receiving loop formed at an end of said strap, said receiving loop having an inner diameter suitable for allowing said strap to pass therethrough, said strap extending through said receiving loop so as to form said wrist loop.

9. The hand strap of claim 8, said spring strip affixed to said strap at a distal end from said wrist loop.

10. The hand strap of claim 7, said wrist loop extending outwardly generally transversely to a longitudinal axis of said strap, said spring strip being a self-coiling strip operable so as to self- roll in a direction toward said wrist loop.

11. A weightlifting hand strap for use with a weightlifting bar comprising:

a strap;

a wrist loop means connected to an end of said strap, said wrist loop means for extending around a human wrist, said wrist loop means extending outwardly generally transversely to a longitudinal axis of said strap; and a spring strip means affixed to said strap, said spring strip means for coiling said strap in a direction facing said wrist loop means.

12. The hand strap of claim 11, said spring strip being a self-coiling strip operable so as to self-roll to thereby roll up said strip around the weightlifting bar.

13. The hand strap of claim 12, said self-coiling strip having a concave side and a convex side and a property that when straightened the strip holds its straightened shape and when bent in a predetermined direction said strip self-rolls around the weightlifting bar.

14. The hand strap of claim 13, said strap being formed of a fibrous material, said strap extending along and over said concave side and said convex side, said strap being in surface-to-surface contact with itself when said strip rolls around the weightlifting bar.

15. The hand strap of claim 11, said wrist loop means comprising a wrist loop formed of said fibrous material integrally connected to said strap.

16. The hand strap of claim 15, said wrist loop comprising:

a receiving loop formed at an end of said strap, said receiving loop having an inner diameter suitable for allowing said strap to pass therethrough, said strap extending through said receiving loop so as to form said wrist loop.

17. A weightlifting hand strap for use with a weightlifting bar comprising:

a strap having a receiving loop formed at one end, said receiving loop having an inner diameter of a size such that said strap can extend through said receiving loop so as to form a wrist receiving loop; and a spring strip means affixed to a distal end of said strap from said receiving loop, said spring strip means for coiling said strap in a direction toward said receiving loop.

18. The hand strap of claim 17, said spring strip means being a self-coiling strip operable so as to self-roll to thereby roll up said strip around the weightlifting bar, said self-coiling strip having a concave side and a convex side and a property that when straightened the strip holds its straightened shape and when bent in a predetermined direction said strip self-rolls around the weightlifting bar.

19. The hand strap of claim 17, said strap comprising:

an inner material surface; and an outer material surface, said spring strip means received between said inner material surface and said outer material surface, said inner material surface and said outer material surface having edges affixed together so as to contain said spring strip means between said edges and between said inner material surface and said outer material surface.

20. The hand strap of claim 19, said inner material surface and said outer material surface each being formed of a cloth material, said edges being stitched together so as to contain said spring strip means therebetween.

* * * * *